US012150492B2

(12) United States Patent
Hamad

(10) Patent No.: US 12,150,492 B2
(45) Date of Patent: Nov. 26, 2024

(54) SOCK WITH INTERNAL GRIPPING SURFACE

(71) Applicant: Joseph Hamad, Harrisburg, PA (US)

(72) Inventor: Joseph Hamad, Harrisburg, PA (US)

( * ) Notice: Subject to any disclaimer, the term of this patent is extended or adjusted under 35 U.S.C. 154(b) by 15 days.

(21) Appl. No.: 18/079,270

(22) Filed: Dec. 12, 2022

(65) Prior Publication Data

US 2024/0188648 A1 Jun. 13, 2024

(51) Int. Cl.
*A41B 11/12* (2006.01)

(52) U.S. Cl.
CPC ..... *A41B 11/128* (2013.01)

(58) Field of Classification Search
CPC ..... A41B 11/128; A41B 11/126; A41B 11/12; A41B 11/008
See application file for complete search history.

(56) References Cited

U.S. PATENT DOCUMENTS 2,837,748 A * 6/1958 Manning ..... A41F 9/00 2/337
3,590,390 A * 7/1971 Howard ..... A41B 11/126 2/312
4,021,860 A * 5/1977 Swallow ..... A41B 11/02 2/239
4,728,538 A * 3/1988 Kaspar ..... D06M 17/06 427/288
6,138,281 A * 10/2000 Chiaruttini ..... A41B 11/02 2/239
6,766,536 B1 * 7/2004 Aarons ..... A41D 19/01558 2/161.3
7,346,935 B1 * 3/2008 Patterson ..... A41B 11/008 2/239
7,346,936 B2 * 3/2008 Vargas ..... A43B 7/146 2/239
7,625,625 B2 * 12/2009 Rios ..... B32B 27/20 156/60
10,076,436 B2 * 9/2018 Jones ..... A43B 7/1445
10,165,803 B2 * 1/2019 Hoeven ..... A41B 17/00
10,194,700 B2 * 2/2019 Mathieu ..... A61F 13/08
10,315,392 B2 * 6/2019 Arici ..... A41B 11/008
10,428,447 B2 * 10/2019 Tuerk ..... A41B 11/126
10,750,794 B2 * 8/2020 Van Tiel ..... A43B 17/16
10,779,578 B2 * 9/2020 Van Tiel ..... A41B 11/121
11,006,686 B2 * 5/2021 Baschak ..... A41D 1/089
11,149,380 B2 * 10/2021 Schott ..... D06C 7/00
11,452,316 B2 * 9/2022 Lee ..... A41B 11/121
11,464,260 B2 * 10/2022 Turbovich ..... A41D 27/08
(Continued)

*Primary Examiner* — Alissa L Hoey
(74) *Attorney, Agent, or Firm* — Johnson | Dalal; Mark C. Johnson

(57) ABSTRACT

A sock with internal gripping surface having a unitary sock body of a flexible fabric material, with an upper terminal end defining an enclosed upper opening, with a distal end opposing the upper terminal end, and with an inner surface enclosing and defining a sock cavity spanning from the enclosed upper opening to the distal end and having a plurality of elastic protuberances each extending inwardly from the inner surface and into the sock cavity a length of approximately 0.25-1.25 mm, continually spanning around a circumference of the inner surface, disposed in tightly spaced configuration with one another, and spanning approximately 35-45 mm from a point proximal to the upper terminal end.

14 Claims, 2 Drawing Sheets

(56) References Cited

U.S. PATENT DOCUMENTS

| | | | | |
|---|---|---|---|---|
| 11,679,035 | B2 * | 6/2023 | Hoffeins | A41B 11/008 602/76 |
| 2004/0221371 | A1 * | 11/2004 | Kato | A43B 1/0045 2/239 |
| 2005/0066544 | A1 * | 3/2005 | Beak | A43B 17/18 36/43 |
| 2005/0091729 | A1 * | 5/2005 | Alley | A41D 19/01558 2/239 |
| 2005/0144703 | A1 * | 7/2005 | Hilbert | A41B 11/008 2/239 |
| 2006/0179546 | A1 * | 8/2006 | Ko | A41B 11/128 2/239 |
| 2006/0260024 | A1 * | 11/2006 | Lee | A41B 11/128 2/239 |
| 2009/0100566 | A1 * | 4/2009 | Schiavino | D06P 1/44 2/244 |
| 2010/0000005 | A1 * | 1/2010 | Dossman | A41D 13/0015 2/125 |
| 2010/0081984 | A1 * | 4/2010 | Coffinardi | A41B 11/126 2/167 |
| 2010/0183814 | A1 * | 7/2010 | Rios | A63B 60/00 427/387 |
| 2010/0281602 | A1 * | 11/2010 | Stabile | A41F 17/00 2/239 |
| 2015/0273310 | A1 * | 10/2015 | Johnston | A41D 1/04 2/22 |
| 2016/0219941 | A1 * | 8/2016 | Hara | A41B 11/008 |
| 2020/0237023 | A1 * | 7/2020 | Miller | A41B 11/128 |
| 2020/0397065 | A1 * | 12/2020 | Jackson | A61K 31/196 |
| 2021/0068482 | A1 * | 3/2021 | Brown | A43B 13/226 |
| 2021/0289850 | A1 * | 9/2021 | Miller | A43B 23/0235 |
| 2022/0125128 | A1 * | 4/2022 | Blecha | D06M 23/04 |
| 2024/0023638 | A1 * | 1/2024 | Merrill | A41B 9/14 |

* cited by examiner

SOCK WITH INTERNAL GRIPPING SURFACE

FIELD OF THE INVENTION

The present invention relates generally to footwear, and, more particularly, relates to socks configured to be retained on a user's foot.

BACKGROUND OF THE INVENTION

Socks are one of the most common pieces of footwear worn by people throughout the world. When wearing socks, however, namely mid-calf, over-the-calf, knee, or over-the-knee socks, many of these socks fall down or otherwise be lowered during use, which many users find problematic and uncomfortable. Some known socks use elastic bands or elastic fabric to generate compression forces designed to retain the socks in their desired position on a user's leg. These known socks are often uncomfortable for the user and can, in many instances, be also painful for a user.

Therefore, a need exists to overcome the problems with the prior art as discussed above.

SUMMARY OF THE INVENTION

The invention provides a sock with internal gripping surface that overcomes the hereinafore-mentioned disadvantages of the heretofore-known devices and methods of this general type and that retains a sock to a user's leg in a safe, comfortable, and effective manner.

With the foregoing and other objects in view, there is provided, in accordance with the invention, a sock with internal gripping surface that includes a unitary sock body of a flexible fabric material, with an upper terminal end defining an enclosed upper opening, with a distal end opposing the upper terminal end, and with an inner surface enclosing and defining a sock cavity spanning from the enclosed upper opening to the distal end, and with a plurality of elastic protuberances each extending inwardly from the inner surface and into the sock cavity a length of approximately 0.25-1.25 mm, continually spanning around a circumference of the inner surface, disposed in tightly spaced configuration with one another, and spanning approximately 35-45 mm from a point proximal to the upper terminal end.

In accordance with a further feature of the present invention, the unitary sock body is of a leather or woven fabric material.

In accordance with yet another feature of the present invention, the plurality of elastic protuberances are tightly spaced approximately 3 mm with respect to one another.

In accordance with an additional feature of the present invention, the plurality of elastic protuberances are uniformly spaced with respect to one another.

In accordance with a further feature of the present invention, the plurality of elastic protuberances are uniformly spaced with respect to one another and are of a silicone material.

In accordance with another feature, an embodiment of the present invention includes a polyester strip body adhesively coupled to the unitary sock body and having the plurality of elastic silicone protuberances directly coupled thereto.

In accordance with a further feature of the present invention, the plurality of elastic protuberances are each of a hemi-spherical shape.

In accordance with an exemplary feature of the present invention, each of the plurality of elastic protuberances extending a length of approximately 0.50 mm.

In accordance with a further feature of the present invention, the plurality of elastic protuberances collectively span around the circumference of the inner surface to form an upper protuberance boundary line and a lower protuberance boundary line parallel to one another.

Also in accordance with the present invention, a sock with internal gripping surface is disclosed that includes a unitary sock body of a flexible fabric material, with an upper terminal end defining an enclosed upper opening, with a distal end, and with an inner surface enclosing and defining a sock cavity spanning from the enclosed upper opening to the distal end and plurality of elastic protuberances each extending a radially length of approximately 0.50 mm inwardly from the inner surface and into the sock cavity, continually spanning around a circumference of the inner surface, disposed in tightly spaced configuration with one another, and spanning less than 75 mm from a point proximal to the upper terminal end.

Although the invention is illustrated and described herein as embodied in a sock with internal gripping surface, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the sock, or from a distal end of the sock to an upper end of the sock.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
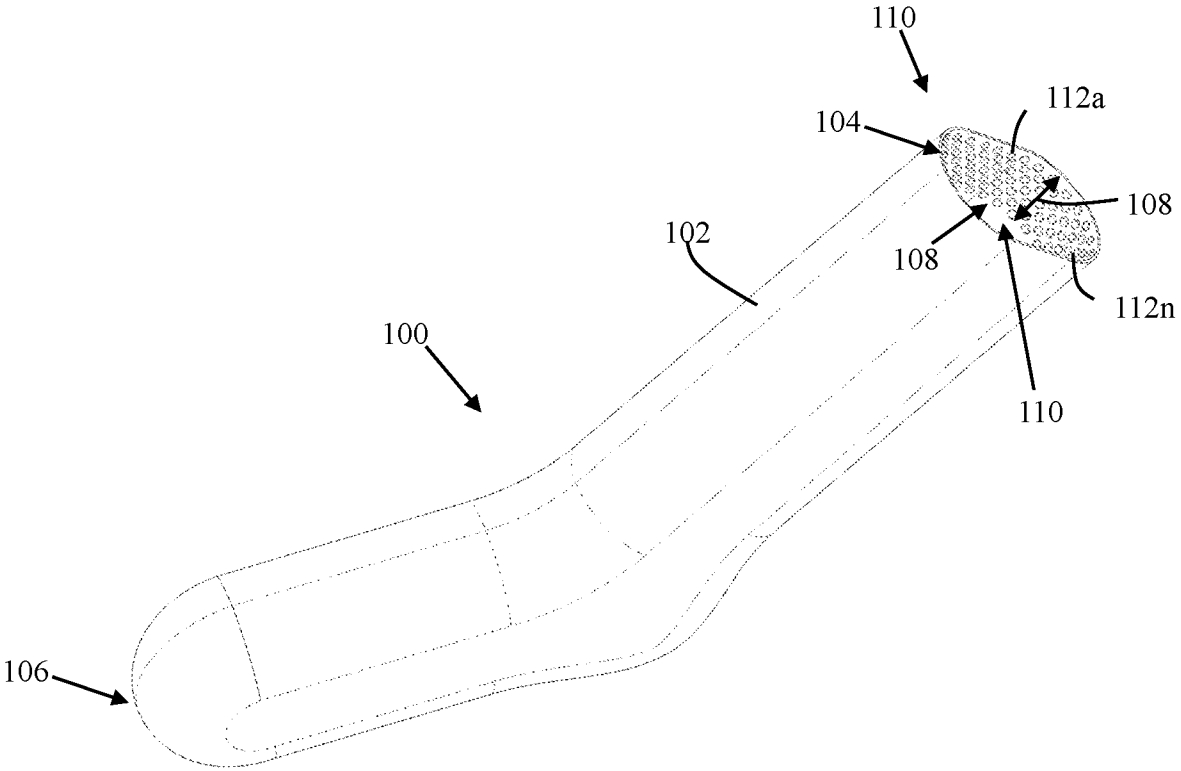
FIG. 1 is a perspective view of a sock with internal gripping surface in accordance with one embodiment of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient sock with internal gripping surface that is operable to be retained on a user's leg in a safe and comfortable manner. Referring now to FIG. 1, one embodiment of the sock with internal gripping surface 100 is shown in a perspective view. FIG. 1 (along with the other figures) shows several advantageous features of the present invention, but, as will be described below, the invention can be provided in several shapes, sizes, combinations of features and components, and varying numbers and functions of the components.

More specifically, the sock 100 is of a unitary sock body 102 of a flexible fabric material, e.g., a leather or woven fabric material, such as cotton. The sock body 102 may be unitary, in that it is formed a single piece of material or operate as a single unit. Said another way, the sock body 102 may be of a monolithic structure. The material of the sock body 102 is also of an inherently elastic material. The sock body 102 includes an upper terminal end 104 defining an enclosed upper opening 108 that may, like most socks, have a diameter ranging from 50-120 mm. The sock body 102 also includes a distal end 106 that may oppose the upper terminal end 104 (as exemplified in the figures). The sock body 102 also includes an inner surface 110 enclosing and defining a sock cavity 200 spanning from the enclosed upper opening 108 to the distal end 106, wherein the distal end 106 may also be at or near the terminal end of the sock body 102. It should be understood that terms such as, "front," "rear," "side," top," "bottom," "distal", and the like are indicated from the reference point of a viewer viewing the sock body 102 depicted in the figures. The sock body 102 also includes an outer surface opposing the inner surface 110 of the sock body 102. It is preferred that the length 108 spans less than 75 mm from a point proximal to the upper terminal end 104 to provide a sock that engages with just enough of a user's skin to retain the sock thereon.

Figure 3:
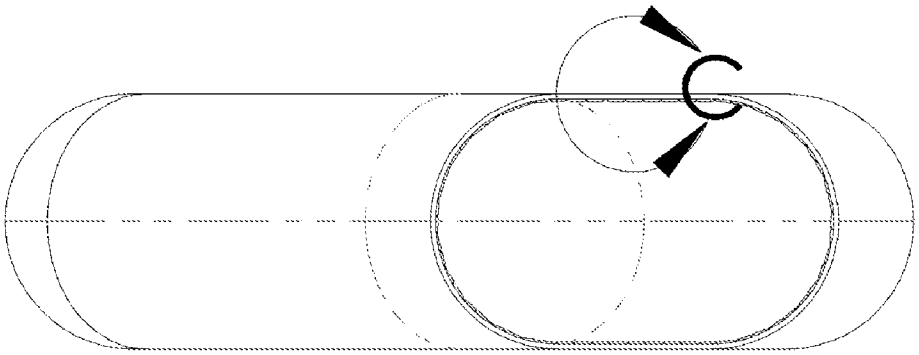
FIG. 3 is a top plan view of the sock with internal gripping surface of FIG. 1.
Figure 4:
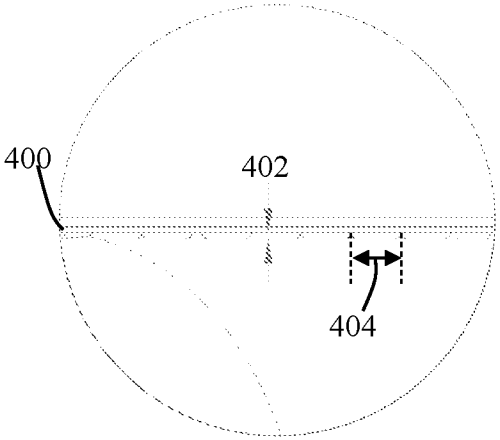
FIG. 4 is a close-up fragmentary view of section C of FIG. 3 in accordance with one embodiment of the present invention.
Figure 2:
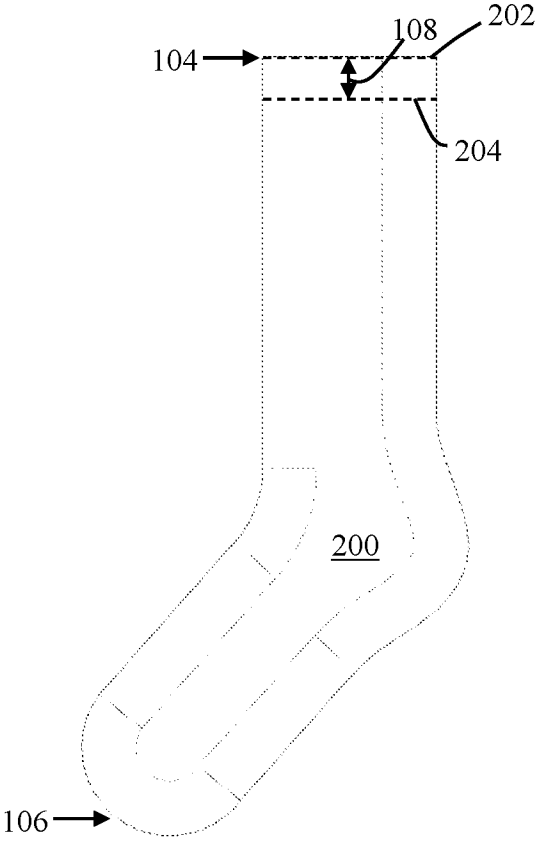
FIG. 2 is a partially transparent and fragmentary view of the sock with internal gripping surface of FIG. 1.

Beneficially, the sock 100 includes a plurality of elastic protuberances 112*a-n* each extending inwardly from the inner surface 110 and into the sock cavity 200, wherein "n" represents any number greater than one. As best seen in FIG. 4, a thickness 402 of each of the plurality of elastic protuberances 112*a-n* of approximately 0.25-1.25 mm, wherein 0.5 mm is the preferred diameter or length. In one embodiment, the thickness 402 of each of the plurality of elastic protuberances 112*a-n* are uniformly the same diameter to provide a level application surface. The plurality of elastic protuberances 112*a-n* may continually and collectively span around a circumference of the inner surface 110 as exemplified also in FIG. 3. The plurality of elastic protuberances 112*a-n* may be disposed in tightly spaced configuration with one another, i.e., less than approximately 5 mm of one another. In a preferred embodiment, the plurality of elastic protuberances 112*a-n* are tightly spaced approximately 3 mm with respect to one another and, as exemplified in FIG. 1, are tightly and uniformly spaced from one another both the vertical direction and the horizontal direction.

In one embodiment, the plurality of elastic protuberances 112*a-n* span approximately 35-45 mm from a point proximal to the upper terminal end 104, i.e., at or near (within 5% of the overall length). In another embodiment, the plurality of elastic protuberances 112*a-n* are uniformly spaced with respect to one another, i.e., the spatial difference between at least one of the elastic protuberances 112*a-n* is the same between other protuberances 112*a-n*. In preferred embodiments, the plurality of elastic protuberances 112*a-n* are of a silicone or other elastomeric material.

To effectuate a more cost-effective production of the sock 100, a polyester strip body 400 is utilized and includes one side or surface that is adhesively coupled to the unitary sock body 102 and having the plurality of elastic silicone protuberances 112*a-n* each individually separated and directly coupled thereto, e.g., using adhesive or heat welding. In another embodiment, each of the plurality of elastic protuberances 112*a-n* are adhesively coupled or heat welded directly to the inner surface 110 of the sock body 102. The polyester strip body 400 may also be of an elastic material. As seen best in FIG. 1 and FIGS. 3-4, the strip body 400 can also be seen having an upper edge that terminates at and is aligned with the upper terminal end 104 of the sock body 102.

In preferred embodiments, the plurality of elastic protuberances 112*a-n* are each of a hemi-spherical shape. This may include or be described as having a partially curved outer surface and a flat distal surface. Said another way, the plurality of elastic protuberances 112*a-n* may be combination of a hemi-spherical and a trapezoidal prism shape. The plurality of elastic silicone protuberances 112*a-n* may also collectively span around the circumference of the inner surface 110 to form an upper protuberance boundary line 202 and a lower protuberance boundary line 204 that are parallel to one another. The formation of the plurality of elastic protuberances 112*a-n* may be a uniform width 108 ranging from approximately 35-45 mm, wherein 38 mm is the preferred width. Each individual elastic protuberances 112*a-n* may be approximately 10-32 mm in length 404. The formation and configuration of the elastic protuberances 112*a-n* enables the sock to stay retained on the user's leg in a safe, secure, and comfortable manner not accomplished with the prior art.

Although a specific order of executing process and utilization steps has been disclosed or depicted, the order of executing the steps may be changed relative to the order shown in certain embodiments. Also, two or more steps shown or described as occurring in succession may be executed concurrently or with partial concurrence in some embodiments. Certain steps may also be omitted for the sake of brevity. In some embodiments, some or all of the process steps described can be combined into a single process.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above described features.

What is claimed is:

1. A sock with internal gripping surface comprising:

a unitary sock body of a flexible fabric material, with an upper terminal end defining an enclosed upper opening, with a distal end opposing the upper terminal end, and with an inner surface enclosing and defining a sock cavity spanning from the enclosed upper opening to the distal end;

a strip body made of an elastic and polyester material that is adhesively coupled to the inner surface of the unitary sock body and includes an upper edge terminating at and aligned with the upper terminal end of the unitary sock body; and a plurality of elastic protuberances each individually separated and directly coupled to the strip body, each extending inwardly from the inner surface and into the sock cavity a thickness of 0.25-1.25 mm, continually spanning around a circumference of the inner surface, disposed in tightly spaced and uniform configuration with one another with each of the plurality elastic protuberances spaced less than 5 mm of one another in both the a vertical direction and a horizontal direction, and spanning 35-45 mm from a point proximal to the upper terminal end.

2. The sock with internal gripping surface according to claim 1, wherein:

the unitary sock body is of a leather or woven fabric material.

3. The sock with internal gripping surface according to claim 1, wherein:

the plurality of elastic protuberances are tightly spaced approximately 3 mm with respect to one another.

4. The sock with internal gripping surface according to claim 1, wherein:

the plurality of elastic protuberances are uniformly spaced with respect to one another and are of a silicone material.

5. The sock with internal gripping surface according to claim 1, wherein:

the plurality of elastic protuberances are each of a hemi-spherical shape.

6. The sock with internal gripping surface according to claim 5, wherein:

each of the plurality of elastic protuberances extending a length of approximately 0.50 mm.

7. The sock with internal gripping surface according to claim 1, wherein:

the plurality of elastic protuberances collectively span around the circumference of the inner surface to form an upper protuberance boundary line and a lower protuberance boundary line parallel to one another.

8. A sock with internal gripping surface comprising:

a unitary sock body of a flexible fabric material, with an upper terminal end defining an enclosed upper opening, with a distal end, and with an inner surface enclosing and defining a sock cavity spanning from the enclosed upper opening to the distal end;

a strip body made of an elastic and polyester material that is adhesively coupled to the inner surface of the unitary sock body and includes an upper edge terminating at and aligned with the upper terminal end of the unitary sock body; and a plurality of elastic protuberances each individually separated and directly coupled to the strip body, each extending a radially thickness of approximately 0.50 mm inwardly from the inner surface and into the sock cavity, continually spanning around a circumference of the inner surface, disposed in tightly spaced and uniform configuration with one another with each of the plurality of elastic protuberances spaced less than 5 mm of one another in both a vertical direction and a horizontal direction, and spanning less than 75 mm—from a point proximal to the upper terminal end.

9. The sock with internal gripping surface according to claim 8, wherein:

the plurality of elastic protuberances collectively span around the circumference of the inner surface to form an upper protuberance boundary line and a lower protuberance boundary line parallel to one another.

10. The sock with internal gripping surface according to claim 8, wherein:

the plurality of elastic protuberances are tightly spaced approximately 3 mm with respect to one another.

11. The sock with internal gripping surface according to claim 8, wherein:

the plurality of elastic protuberances are of a silicone material.

12. The sock with internal gripping surface according to claim 8, wherein:

the plurality of elastic protuberances are each of a hemi-spherical shape.

13. Sock with internal gripping surface according to claim 12, wherein:

each of the plurality of elastic protuberances extending a length of approximately 0.50 mm.

14. A sock with internal gripping surface comprising:

a unitary sock body of a flexible fabric material, with an upper terminal end defining an enclosed upper opening, with a distal end opposing the upper terminal end, and with an inner surface enclosing and defining a sock cavity spanning from the enclosed upper opening to the distal end;

a strip body made of an elastic and polyester material that is coupled to the inner surface of the unitary sock body and includes an upper edge terminating at and aligned with the upper terminal end of the unitary sock body; and a plurality of elastic protuberances each individually separated and directly coupled to the strip body, each extending inwardly from the inner surface and into the sock cavity a thickness of 0.25-1.25 mm, continually spanning around a circumference of the inner surface, disposed in tightly spaced configuration less than 5 mm of one another, and spanning 35-45 mm from a point proximal to the upper terminal end.

* * * * *